United States Patent [19]

Breen et al.

[11] 4,270,501

[45] Jun. 2, 1981

[54] BEHAVIORAL FUEL-SAVING METHOD AND APPARATUS FOR A MOTOR VEHICLE

[76] Inventors: William C. Breen, 507 Greenwood Ave., Akron, Ohio 44320; Richard E. Schulman, 105 Catherine St., Kalamazoo, Mich. 49007

[21] Appl. No.: 970,384

[22] Filed: Dec. 18, 1978

[51] Int. Cl.[3] ..... F02B 11/08

[52] U.S. Cl. ..... 123/350; 123/389; 123/396

[58] Field of Search ..... 123/97 R, 103 R, 103 C, 123/103 E, 102, 350, 389, 396, 378

[56] References Cited

U.S. PATENT DOCUMENTS

| | | | |
|---|---|---|---|
| 2,077,555 | 1/1932 | Frantz | 137/144 |
| 2,111,284 | 3/1938 | Girl et al. | 177/311.5 |
| 2,817,323 | 12/1957 | Nallinger | 123/103 E |
| 2,822,881 | 2/1958 | Treharne | 180/82.1 |
| 3,268,027 | 8/1966 | Leichsenring | 180/82.1 |
| 3,982,511 | 9/1976 | Schniers et al. | 123/103 E |
| 4,176,633 | 12/1979 | McCabe | 123/102 |

FOREIGN PATENT DOCUMENTS

| | | | |
|---|---|---|---|
| 2547385 | 4/1977 | Fed. Rep. of Germany | 123/103 E |

*Primary Examiner*—Craig R. Feinberg
*Attorney, Agent, or Firm*—Frederick K. Lacher

[57] ABSTRACT

Saving fuel in the operation of a motor vehicle by providing an increased resistance to depression of a gas pedal at increased velocities in a predetermined speed range from a lower velocity up to a predetermined upper velocity. A piston is urged against the pedal by a spring in a cylinder. Adjustments in vacuum in the cylinder are utilized to adjust the spring force constituting the resistance to pedal depression of the piston.

14 Claims, 3 Drawing Figures

BEHAVIORAL FUEL-SAVING METHOD AND APPARATUS FOR A MOTOR VEHICLE

BACKGROUND OF THE INVENTION

This invention relates to a system for conserving energy in the operation of a motor vehicle in which the fuel supply to the vehicle is controlled by a foot pedal. It is well known that if the operator can be constrained to operate the vehicle at a speed not greater than the national speed limit of 55 miles per hour, there will be a great savings in fuel. This is because the fuel consumption at speeds over 55 miles per hour is much greater than at 55 or lower. It has also been determined that there are fewer injuries and fatalities resulting from accidents at speeds of 55 miles per hour or less.

In the past, speed control devices have been proposed for motor vehicles. These have included adding an additional spring to resist depression of the foot pedal at a set speed after which the pedal resistance is increased as the spring is compressed. Because the apparatus is actuated at different pedal positions the operator can manipulate the pedal to obtain engagement at an artificially depressed position of the pedal such as when the vehicle is going up hill or being accelerated rapidly. Thereafter the spring force resisting depression of the pedal may be minimal because the amount of pedal depression required to travel at speeds over the speed limit is less than the pedal depression at which the spring is engaged.

In addition, even if the spring is engaged in a normal manner at the speed limit and on a level road, the resistance to pedal depression is a function of the spring rate and not the vehicle speed. Therefore if the spring rate or force per inch of spring retraction is great at speeds slightly in excess of the speed limit to reduce marginal speeding, the force required to go over higher speeds will be so great the operator will not have the strength to depress the pedal and cause the vehicle to travel at high speeds. This creates a safety hazard in that the operator will not be able to operate the vehicle at high speeds in an emergency to avoid an accident. On the other hand, if the spring rate is low enough to permit depression of the pedal at high speeds, it may not be sufficient to provide initial high resistance to depression of the pedal at velocities in the lower part of the speed range. This apparatus may also be tampered with by the operator to remove or reduce the constraining force which is not desirable.

In other speed control devices, warnings are given the operator when the speed limit is reached; however, no appreciable resistance is provided to constrain the operator from operating the vehicle at speeds over the speed limit. Some speed control devices have vacuum and/or spring resistance to pedal depression which is applied at a certain speed; however, there is no correlation between the speed of the vehicle over the speed limit and the resistance to pedal depression.

SUMMARY OF THE INVENTION

It is a principal object of the invention to provide a method and system of conserving energy by controlling the resistance to depression of a fuel-regulating foot pedal in response to increases in vehicle velocity over a predetermined speed in order to constrain the operator and reduce the occurrence and duration of vehicle operation at velocities over that speed.

Another object is to provide a method and system in which the increases in resistance to depression of the foot pedal are a function of the increases in vehicle velocity during at least a part of a predetermined speed range.

A further object is to provide a method and system in which a substantial initial resistance to depression of the pedal is applied at a velocity in the lower part of the speed range.

Another object is to provide a method and system in which the resistance to depression is decreased at a rate which is increased as the velocity decreases.

A further object is to provide an energy conservation system in which the resistance to pedal depression is applied at a predetermined speed and increased in response to communication from the speedometer at predetermined velocities up to a maximum pressure.

A still further object is to provide a system in which the resistance to pedal depression is adjusted by a combination of spring force and fluid pressure.

Another object is to provide a system in which a pressure-sensing apparatus provides an indication of the force resisting pedal depression.

A further object is to provide a system with valves for regulating the pressure exerted on the pedal.

A still further object is to provide a system in which the controls include a microprocessor having a memory programmed so that the output from the microprocessor will signal the desired adjustments to the pedal depression resistance in response to input from the speedometer.

DESCRIPTION OF THE PREFERRED EMBODIMENT

Figures 1, 2:
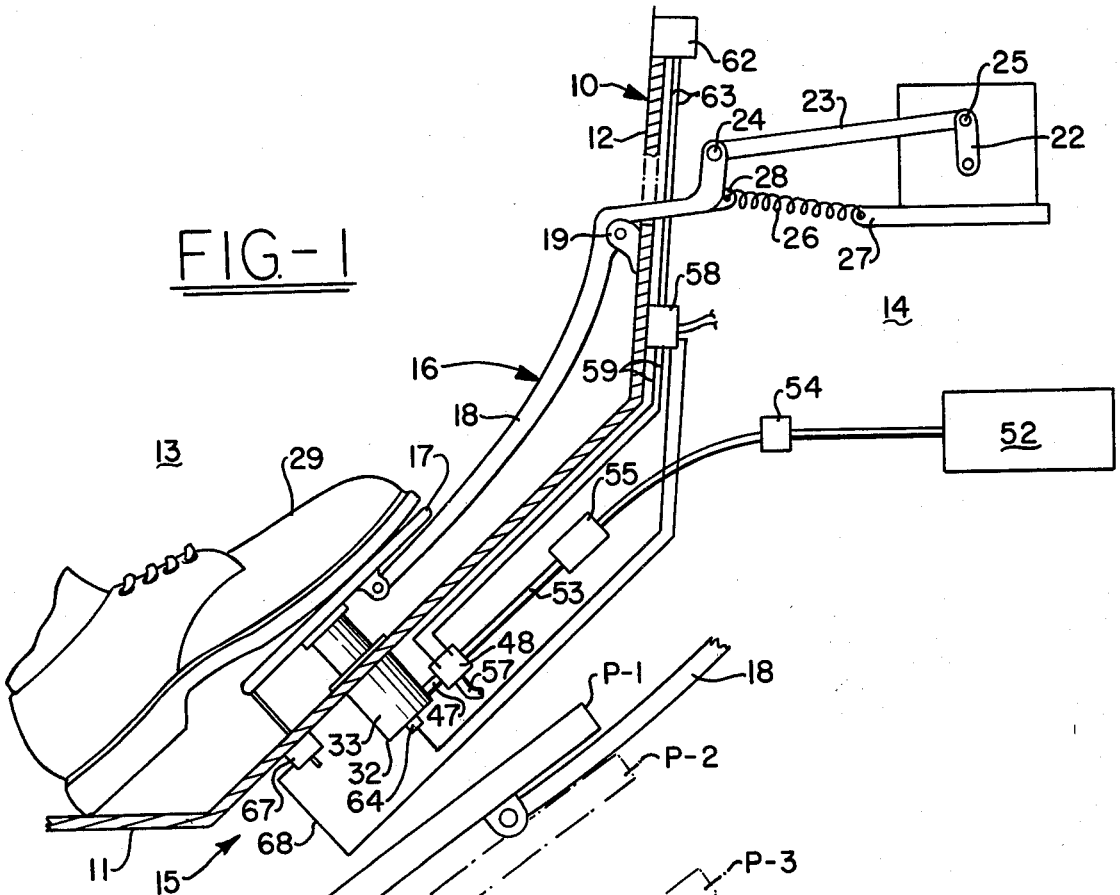
FIG. 1 is a schematic side elevation in section showing the vehicle floor, fire wall and foot pedal and the apparatus of the invention mounted on the vehicle.
FIG. 2 is an enlarged sectional view of the pedal resisting spring and piston-cylinder arrangement illustrating the method and system at different pedal positions shown in chain-dotted lines.

Referring to FIG. 1, part of a powered vehicle such as an automobile 10 is shown having a floorboard 11 extending in a horizontal direction and then at an angle to join with a fire wall 12 extending vertically between a passenger compartment 13 and an engine compartment 14. An energy conservation system 15 embodying the invention operates to control the movement of a fuel control linkage 16 having a foot pedal member such as gas pedal 17 pivotally mounted on a lever arm 18 which is pivotally mounted on a bracket 19 fastened to the fire wall 12. The lever arm 18 extends through an opening in the fire wall 12 and is connected to a throttle arm 22 of the engine carburetor by a connecting link 23 at pivotal connections 24 and 25. The lever arm 18 is generally in the shape of a bell crank so that when the gas pedal 17 is depressed in the direction indicated by letter A in FIG. 1, the lever arm will rotate about the pivot on bracket 19 and pull the connecting link 23 to the left causing a counterclockwise rotation of the throttle arm 22. This rotation of the throttle arm 22 in a counterclockwise direction will generally cause more fuel to be used by the engine (not shown) of the automobile 10 to increase the velocity of the automobile when it is in gear and being driven on a highway.

Figure 3:
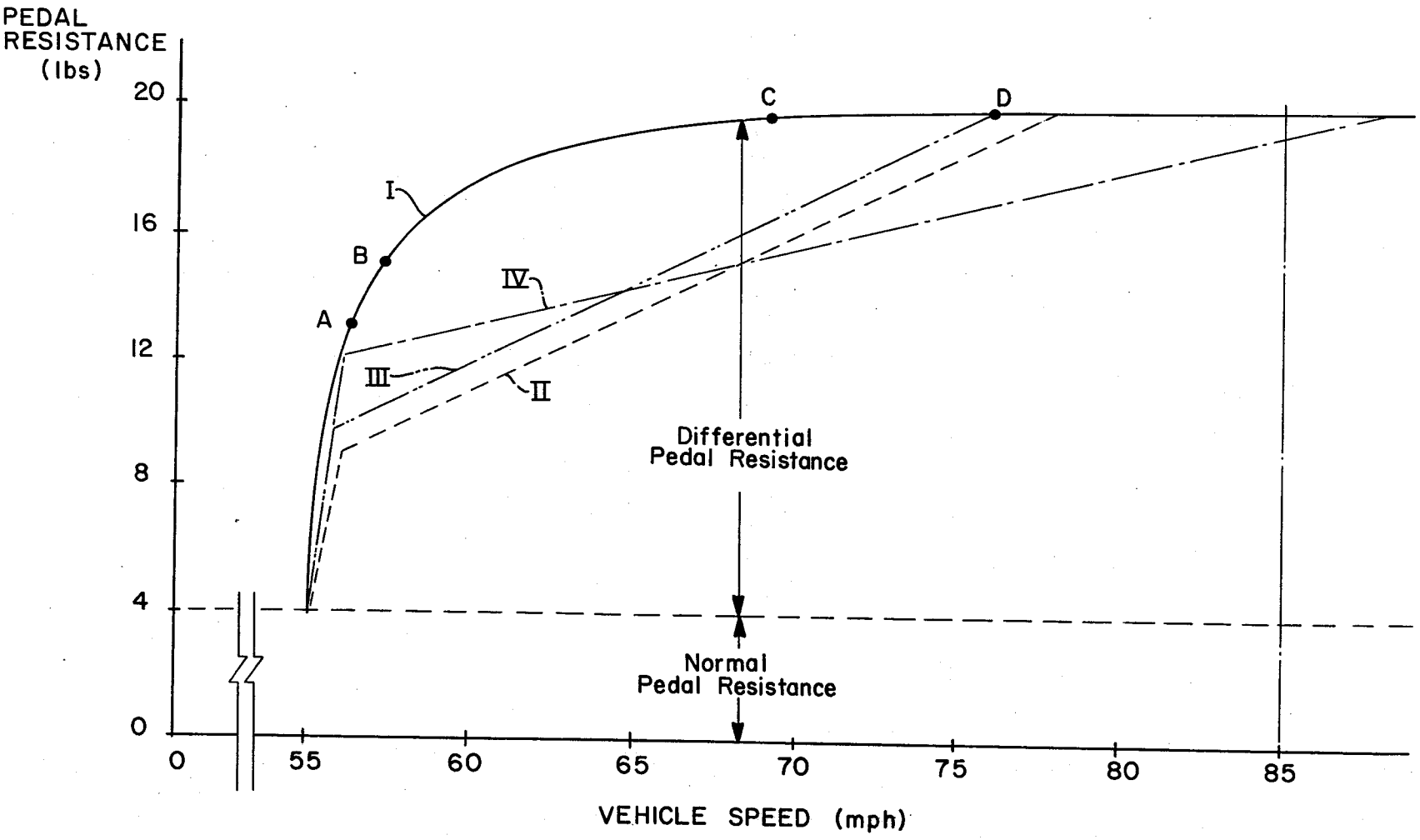
FIG. 3 is a graphic illustration of the programming of the differential pedal resistance in pounds as well as the total pedal resistance provided by the apparatus of the invention at indicated velocities. The four different lines on the graph show pedal resistance for the preferred system and three modifications thereof.

Rotation of throttle arm 22 in a clockwise direction decreases the amount of fuel used by the engine in response to release of the foot pressure on the pedal 17 so that the lever arm 18 may be rotated in a clockwise direction around the pivot of bracket 19. A spring 26 extends between a bracket 27 on the engine and an ear member 28 fastened to lever arm 18 and provides a normal resistance to pedal depression or normal pedal resistance of 4 pounds. This is shown in FIG. 3 in a dotted line. Numeral 29 shows an operator's foot in a normal position for pressing and releasing the gas pedal 17.

Referring to FIGS. 1 and 2, a pedal movement resisting means such as piston-cylinder assembly 32 is shown for controlling resistance to depression of the gas pedal 17 in the direction A. This assembly 32 includes a cylinder 33 having a closed end 34 and an open end 35. A cup-shaped piston 36 is slidably mounted in the cylinder 33. A resilient member such as coil spring 37, shown in FIG. 2, is positioned within the piston-cylinder assembly 32 and engages the closed end 34 of the cylinder 33 and a closed end 38 of the piston 36.

In this preferred embodiment, the piston-cylinder assembly 32 is mounted in an opening 39 in the floorboard 11 beneath the gas pedal 17. It is understood that the piston-cylinder assembly 32 may be mounted in the floorboard 11 or fire wall 12 at other positions beneath the lever arm 18 so as to exert a force directly on the lever arm. A flange 42 at the open end 35 of the cylinder 33 overlies the floorboard 11 and may be fastened thereto by screws 43. A retaining and sealing ring 44 may be threaded in the cylinder 33 at the open end 35 for sealing engagement with the cylindrical outer surface of the piston 36. The ring 44 may also act as a stop to limit the movement of the piston 36 out of the cylinder 33 by engagement with flange 45 at the open end of the piston 36.

The cylinder 33 has an opening 46 for receiving a hose 47 which is connected to a valve assembly 48. Incorporated in the valve assembly 48 is an exhaust valve 49 in communication with a vacuum source such as engine manifold 52. A vacuum hose 53 connects the exhaust valve 49 with the manifold 52 and may include a check valve 54 restricting flow to one direction from the exhaust valve to the manifold. A vacuum chamber reservoir 55 may also be positioned along the vacuum hose 53 between the exhaust valve 49 and the check valve 54 to retain a relatively constant source of vacuum to operate the system.

The valve assembly 48 may also include an intake valve 56 which is in communication with the atmospheric pressure through an intake hose 57. Power means such as solenoids (not shown) may be provided to actuate the exhaust valve 49 and intake valve 56 when electrical impulses are received to open and close the valves.

In accordance with the invention, suitable controls for the intake valve 56 and exhaust valve 49 are provided by a microprocessor 58 which is mounted on the fire wall 12 and electrically connected with the valve assembly 48 by wires 59. A velocity measuring apparatus such as a speedometer 62 for indicating the velocity in terms of the distance travelled in a specified time such as miles per hour is also mounted on the fire wall 12. Wires 63 provide an electrical connection between the speedometer 62 and the microprocessor 58.

The pressure in the cylinder 33 which is also an indication of the force exerted by the piston 36 on the gas pedal 17 is measured and sensed by a pressure sensing and indicating pressure sensor 64 in communication with the chamber within the cylinder 33. The pressure sensor 64 may be mounted in an opening 65 at the closed end 34 of the cylinder 33 as shown in FIG. 2 or may be in communication with the hose 47 between the cylinder 33 and valve assembly 48. The pressure sensor 64 is connected by wires 66 to the microprocessor 58 as shown in FIG. 1.

The piston-cylinder assembly 32 is installed with the coil spring 37 in compression so that in the extended condition, the piston 36 will resist movement of the gas pedal 17, shown in pedal position P-1, toward the floorboard 11 with a substantial force. In the present embodiment, the spring 37 exerts a force in compression against the piston 36 of 16 pounds and thereby resists depression of the gas pedal 17 with a force of 16 pounds. The distance between the pedal position indicated by P-1 in FIG. 2 and the fully depressed pedal position indicated by P-4 in FIG. 2 is around 2 inches and the compression of the spring 37 increases the force of the spring against the piston 36 and consequently against the gas pedal 17 from 16 pounds to 21 pounds. The spring rate of spring 37 is $2\frac{1}{2}$ pounds per inch in compression. In the embodiment shown, the diameter of the piston 36 is 3 inches and the engine manifold 52 provides a negative pressure of from zero to 7 pounds per square inch.

In operation of the automobile 10 equipped with the energy-saving system 15 embodying this invention, the piston 36 is pulled down into the retracted position shown in full lines in FIG. 2 when the engine is started and the automobile is not moving. This is accomplished by control from the microprocessor 58 which is also energized when the automobile ignition is turned on and the microprocessor receives input from the speedometer 62 indicating zero velocity. As shown in FIG. 3, the microprocessor 58 is programmed for zero differential pedal resistance at zero velocity and therefore an electrical impulse is transmitted to the power means actuating the exhaust valve 49 to open the valve and provide communication between the chamber within the cylinder 33 and the manifold 52. The vacuum or negative pressure of 2.97 pounds per square inch operating on the piston 36 having a 3-inch diameter and an area of 7.07 square inches provides a negative pressure of 21 pounds to pull the piston 36 down into the cylinder 33 and out of engagement with the gas pedal 17.

At a predetermined velocity which preferably is the national speed limit of 55 miles per hour, the microprocessor 58 is programmed to receive an input signal from the speedometer 62 and then transmit an electrical impulse to the power means for the intake valve 56 opening the valve to provide communication between the atmosphere and the space within the cylinder 33 to reduce the vacuum within the cylinder. The amount of air flowing through the intake valve 56 is regulated by the microprocessor 58 in response to the signal from the pressure sensor 64 which will indicate that the pressure in the chamber of cylinder 33 has been increased to an amount at which the spring retracting force is less than the spring extending force.

Accordingly, the piston 36 will be released towards the position where the differential pedal resistance is increased as shown in FIG. 3. The amount of reduction in spring retracting force is programmed to provide a substantially large initial resistance to depression of the gas pedal 17. There will, therefore, be an appreciable effort required of the operator in pressing the foot 29 against the gas pedal 17 to increase the velocity of the automobile 10 above the speed limit of 55. This is shown by line I in the graph of FIG. 3 at point A where the differential pedal pressure exerted by the piston 36 is 9.25 pounds applied to the gas pedal 17 when the velocity reaches 56 miles per hour. This condition is also shown at position P-2 in FIG. 2 where the gas pedal 17 is depressed around 0.4 inch and the force exerted by the spring 26 and spring 37 is 21 pounds.

In accordance with the invention, the desired differential pedal resistance is 9.25 pounds which is achieved by providing a counteracting vacuum backpressure of 7.75 pounds or a negative vacuum pressure of 1.1 pounds per square inch which is programmed on the microprocessor to provide the 9.25 pounds differential pedal resistance pressure against the gas pedal 17. This pedal resistance is in addition to the normal pedal resistance of 4 pounds making a total pedal resistance pressure of 13.25 pounds at 56 miles per hour. As shown in the graph of FIG. 3, the added differential pedal resistance is substantial and acts as a deterrent to marginal speeders who tend to drive at speeds slightly greater than the speed limit.

Actuation of the intake valve 56 and exhaust valve 49 and the transmittal of electrical impulses to control the valves may start a timer incorporated in the microprocessor 58 which limits further actuation or transmittal of output to the valve assembly 48 for a reasonable delay period of about three seconds so that small fluctuations in velocity will not result in continuous changes in the resistance to depression of the gas pedal 17. At the end of the three-second delay period, the microprocessor 58 is programmed to provide additional output to actuate the valves 49 and 56 as needed at other speeds.

If the velocity of the automobile 10 is increased to a higher speed such as 57 miles per hour, for example, there is additional input from the speedometer 62 to the microprocessor 58. As shown by letter B on line I in FIG. 3, the microprocessor is programmed to transmit an electrical impulse to the intake valve 56 causing additional air to flow from the atmosphere to the cylinder chamber and reduce the retracting force on the spring 37 to a point where the pressure sensor 64 indicates that the differential pedal resistance is 11 pounds. The required negative vacuum pressure of 0.99 pounds per square inch within the cylinder 33 may be calculated in the same manner as set forth above for a velocity of 56 miles per hour with the pedal deflection being approximately 0.8 inch and the spring force being 22 pounds.

As shown by line I in FIG. 3, the differential pedal resistance at higher speeds increases at a rate which decreases as the velocity increases providing a curvilinear relationship between the resistance to pedal pressure and the increase in velocity. The microprocessor 58 is programmed to adjust the opening of the intake valve 56 at predetermined speeds to provide the differential pedal resistance shown in FIG. 3.

This relationship which is maintained in response to signals from the pressure sensor 64 and speedometer 62 is also illustrated at a speed of 70 miles per hour indicated by letter C on the graph of FIG. 3 and by the pedal position P-3 in FIG. 2. At this speed the normal pedal depression is around 1.36 inches and the spring pressure is 23.4 pounds. In order to provide a differential pedal resistance of 15.8 pounds, the spring force needs to be reduced by 3.6 pounds and this can be accomplished by a vacuum or negative pressure of 0.51 pounds per square inch. In other words, the pressure within the cylinder 33 would be 14.18 pounds per square inch or the atmospheric pressure of 14.69 pounds per square inch minus the vacuum needed of 0.51 pounds per square inch.

This relationship which is maintained in response to signals from the pressure sensor 65 and speedometer 62 is provided until the speed reaches a second predetermined velocity of 76 miles per hour shown at letter D in FIG. 3. At the position P-1 of the pedal 17, the intake valve 56 is completely open so that the cylinder pressure is equal to the atmospheric pressure and the full 16 pounds differential pedal resistance is exerted against the gas pedal 17 which with the normal pedal pressure of 4 pounds provides a maximum pedal resistance of 20 pounds. With the pedal in position P-4 shown in FIG. 2, the pedal resistance will be 25 pounds because of the added deflection of the spring 37.

It is understood that because of the greater and lesser amounts of pedal depression required to attain the same velocity when going uphill or downhill the above calculations may have to be modified within the 5 pounds represented by the 2-inch deflection between no pedal depression at P-1 and the maximum pedal depression of 2 inches at P-4 which would result in a 5-pound maximum variation from the programmed differential pedal resistance shown in FIG. 3. It is expected that this variation will not be greater than plus or minus one pound and, if desired, this variation can be compensated for by a pedal depression sensor 67 connected by wires 68 to the microprocessor 58.

In the event of failure of the microprocessor 58 or interruption in the supply of vacuum from the manifold 52, the gas pedal 17 may still be depressed but against the full resistance of spring 37. In this way, the apparatus will physically allow every driver to accelerate the automobile 10 to the maximum speed in an emergency.

When the automobile 10 is being operated at a relatively high velocity and the speed is decreased as from 70 miles per hour shown at C in FIG. 3 to 57 miles per hour as shown at B, the differential pedal resistance will be reduced from 15.8 pounds to 11 pounds or a reduction of 4.8 pounds less pressure required on the pedal 17. This differentially reinforces deceleration by the operator. As shown in FIG. 3, the microprocessor 58 is programmed so that the rate of decrease in resistance to depression of the gas pedal 17 during a decrease in velocity is increased as the velocity decreases. This further reinforces the deceleration to a more moderate speed such as the national speed limit of 55 miles per hour.

As indicated above, the system 15 is especially adapted to conserve energy in the operation of the automobile by applying a predetermined resistance to depression of the gas pedal 17 at a first predetermined velocity such as the speed limit of 55 miles per hour. Then as the operator increases the velocity and the fuel consumption, the resistance to depression of the gas pedal 17 is increased by predetermined increments shown by line I in the graph of FIG. 3 in response to increases in vehicle velocity. As the gas pedal 17 is further depressed and the automobile velocity increases, the vacuum in the cylinder 33 is reduced to further increase the resistance to depression of the pedal.

Therefore, between the first predetermined velocity or speed limit of 55 miles per hour and a second predetermined velocity such as 76 miles per hour, shown at D on line I in the graph of FIG. 3, the effort required by the operator to attain higher velocities is differentially increased. This differential punishment procedure acts to constrain the operator and reduce the occurrence of automobile operation at velocities over the speed limit. In addition, when the automobile 10 is traveling at a velocity over the speed limit and the operator reduces the depression of the gas pedal 17, the velocity will decrease and this decrease in velocity will cause a decrease in the resistance to depression of the gas pedal and differentially reinforce deceleration to the speed limit.

As shown by line I in the graph of FIG. 3, the microprocessor 58 or a servomechanism of a type well known in the art can be set up or programmed so that the rate of increase in resistance to depression of the gas pedal 17 during at least a part of the speed range between the speed limit and the upper predetermined velocity of 76 miles per hour is decreased as the velocity increases. Likewise, during a decrease in the velocity, the rate of decrease in resistance to depression of the gas pedal 17 in at least a part of the speed range between the higher velocity of 76 miles per hour and the speed limit of 55 miles per hour is increased as the velocity decreases.

As shown in the graph of FIG. 3, the differential pedal resistance may be tailored to meet special driving conditions and special conditions for different kinds of vehicles. In this respect, lines II, III and IV illustrate applications of this invention where the differential pedal resistance is applied on a linear instead of a curvilinear relationship between velocity and resistance to pedal deflection. In all cases, however, the initial application of differential pedal resistance from the speed limit to a velocity of 56 at the lower part of a speed range of from 55 to a maximum of 88 miles per hour provides an initial increase in the resistance to pedal depression which is substantially large so that there is a significant effort required of the operator to increase the velocity above the speed limit.

It is within the scope of this invention to provide compensation for the size of the operators to increase or decrease the differential pedal resistance. This may be accomplished by providing a weight sensor in the operator's seat which is connected to the microprocessor 58. By programming the microprocessor 58 to reduce the differential pedal resistance when input is received to indicate the operator is lighter than a predetermined weight and to increase the differential pedal resistance when the input indicates the operator is heavier than the predetermined weight, compensation for different size operators may be provided.

The microprocessor 58 may also be programmed so that in response to turning off the ignition, a timer incorporated in the microprocessor is actuated to provide a measured time interval such as ten seconds following the time of turning off the ignition. During the time interval, the exhaust valve 49 is open providing communication to the reservoir 55 and maintaining a vacuum in the cylinder 33 so that the piston 36 is held in the retracted position P-4. Upon the elapse of the time interval, the microprocessor 58 may transmit an electrical impulse to the power means to open the intake valve 56 and reduce the vacuum in the cylinder 33 permitting the release of the piston 36 so that it may be returned to the extended position P-1 shown in FIG. 2. By providing the delay, the system may be examined to determine whether the valves 49 and 56 have been bypassed. If they have been bypassed, the piston 36 will immediately return to the extended position upon turning off the ignition and stopping of the vehicle engine. On the other hand, if the valves 49 and 56 have not been bypassed, the piston 36 will not return to the extended position until the valves 49 and 56 are actuated after the time interval elapses.

While certain representative embodiments and details have been shown for the purpose of demonstrating the invention, it will be apparent to those skilled that various changes and modifications may be made therein without departing from the spirit or scope of the invention.

We claim:

1. An energy convervation system for a powered vehicle in which the fuel supplied is controlled by the operator depressing and releasing a foot pedal member in an operating range from a fully depressed position to an extended position comprising movement resisting means engageable with said pedal member within said operating range to resist the depression of said pedal member by the operator's foot, velocity measuring means, control means connected to said velocity measuring means and to said movement resisting means, said control means actuating discrete incremental preselected adjustments to said movement resisting means for changing resistance to depression of said pedal member within said operating range in response to communications from said velocity measuring means at predetermined vehicle velocities, said adjustments to said movement resisting means differentially increasing the effort required to depress said pedal member at higher velocities and differentially decreasing the effort required to depress said pedal member at lower velocities within said operating range so that the operator is constrained to reduce the occurrence and duration of vehicle operation at velocities over a predetermined vehicle velocity.

2. A system according to claim 1 wherein said control means includes a microprocessor with a memory programmed so that said microprocessor will transmit impulses to actuate said movement resisting means to provide said adjustments in response to signals from said velocity measuring means at said predetermined vehicle velocities.

3. A system according to claim 1 wherein said velocity measuring means is a speedometer indicating velocities in terms of distances travelled in a specified time.

4. A system according to claim 3 wherein said communications from said velocity measuring means to said control means consist of signals transmitted at predetermined velocities to said control means.

5. A system according to claim 1 wherein said movement resisting means includes a resilient member for resisting the depression of said pedal member by the operator's foot.

6. A system according to claim 5 wherein said resilient member is a coil spring.

7. A system according to claim 6 wherein said movement resisting means includes power means for reducing the pressure exerted on said pedal means by said spring.

8. A system according to claim 7 wherein said power means includes a piston-cylinder assembly connected to a source of fluid pressure differential for actuating the assembly and said piston of said assembly being engageable with said pedal member within said operating range.

9. A system according to claim 10 wherein said source of fluid pressure differential is a vacuum source at the power supply.

10. A system according to claim 8 wherein said control means includes a pressure sensing and indicating apparatus in communication with said piston-cylinder assembly for sensing the pressure in said cylinder chamber and thereby providing an indication of the force exerted by said piston to reduce the pressure on said pedal member.

11. A system according to claim 10 wherein said control means further includes valve means for regulating the pressure in said cylinder at different vehicle velocities in accordance with the signals received from said velocity measuring means so that predetermined resistances to depression of said foot pedal member are provided at said different vehicle velocities.

12. A system according to claim 11 wherin said valve means includes an intake valve between said cylinder and the space outside said cylinder to allow air under atmospheric pressure to enter said cylinder by opening said intake valve and thereby increase the pressure in the cylinder so that the amount of pressure exerted by said piston on said pedal member is increased.

13. A system according to claim 12 wherein said valve means includes an exhaust valve between said cylinder and said vacuum source to reduce the pressure in said cylinder by opening said exhaust valve and thereby reduce the pressure exerted by said piston on said pedal member.

14. A system according to claim 13 wherein said valve means includes a check valve between said cylinder and said vacuum source to limit flow of air to one direction from said cylinder to said source of vacuum.

* * * * *

UNITED STATES PATENT OFFICE

CERTIFICATE OF CORRECTION

Patent No. 4,270,501 Dated June 2, 1981

Inventor(s) William C. Breen and Richard E. Schulman

It is certified that error appears in the above-identified patent and that said Letters Patent are hereby corrected as shown below:

Column 8, line 19, "convervation" should read --conservation--.

Column 9, line 4, "10" should read --8--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*